United States Patent [19]

Helm

[11] 4,173,922

[45] Nov. 13, 1979

[54] METHOD FOR MAKING SIDE SEAM ENVELOPES FROM A WEB

[75] Inventor: Herbert W. Helm, Hollidaysburg, Pa.

[73] Assignee: F. L. Smithe Machine Company, Inc., Duncansville, Pa.

[21] Appl. No.: 867,328

[22] Filed: Jan. 5, 1978

Related U.S. Application Data

[63] Continuation of Ser. No. 758,752, Jan. 12, 1977, abandoned, which is a continuation of Ser. No. 569,855, Apr. 21, 1975, abandoned.

[51] Int. Cl.[2] ..... B31B 21/00

[52] U.S. Cl. ..... 93/63 M

[58] Field of Search ..... 93/63 R, 63 M, 61 A, 93/61 R, 13; 229/69

[56] References Cited

U.S. PATENT DOCUMENTS

| | | | |
|---|---|---|---|
| 2,054,832 | 9/1936 | Potdevin | 93/63 M X |
| 2,153,848 | 4/1939 | Shea et al. | 93/63 M |
| 2,673,497 | 3/1954 | Heitmann | 93/63 R |
| 3,344,719 | 10/1967 | Weisshuhn | 93/63 M |
| 3,628,304 | 12/1971 | Hornung | 93/63 M X |

*Primary Examiner*—James F. Coan

*Attorney, Agent, or Firm*—Stanley J. Price, Jr.; John M. Adams

[57] ABSTRACT

A paper web is unwound and conveyed through an envelope making machine where a side flap cutting device forms side flaps in the side edges of the web. Scorer rollers form longitudinal scores in the side flaps and the side flaps are thereafter folded along the score lines. Other scorer rollers form transverse score lines for the top and bottom flaps of the envelope. Envelope blanks having the folded side flaps are thereafter severed from the web and separated from each other. After the blanks are severed from the web, gum is applied to the upper surface of the side flaps of the severed envelope blanks and the bottom flap is folded into overlying relation with the folded side flaps to form the pocket in the envelope. The so formed envelopes are thereafter collated into overlying relation with the edges of the top flap exposed. Gum is applied to the top flaps and dried. The top flap is then folded into overlying relation with the bottom flap.

4 Claims, 2 Drawing Figures

METHOD FOR MAKING SIDE SEAM ENVELOPES FROM A WEB

CROSS REFERENCES TO RELATED APPLICATIONS

This application is a continuation of copending application Ser. No. 758,752 filed on Jan. 12, 1977, now abandoned, entitled "Method For Making Side Seam Envelopes From A Web", which in turn is a continuation of application Ser. No. 569,855 filed on Apr. 21, 1975, entitled "Method For Making Side Seam Envelopes From A Web", now abandoned.

BACKGROUND OF THE INVENTION

1. Field of the Invention

This invention relates to a method for continuously making inside side seam envelopes from a web and more particularly to a method for continuously making shaped and scored envelope blanks from a web and thereafter making inside side seam envelopes from the envelope blanks.

2. Description of the Prior Art

In the known methods for continuously making side seam envelopes from a web the envelope forming operations such as scoring the web longitudinally and transversely to form the side, top and bottom flaps, folding the side flaps and applying glue to the folded side flaps are all performed before the blank is severed from the web. With this arrangement, the cut off apparatus must utilize a rotating anvil rather than a stationary anvil to sever the blank from the web. Also, with each envelope size change the diameter of the side flap gummers must be changed. This requires changing a substantial number of parts at each size change and requires substantial size change time.

SUMMARY OF THE INVENTION

The present invention is directed to a method for continuously forming side seam envelopes from a web that includes a series of sequential envelope forming operations on the web and thereafter severing the envelope blanks from the web. Other sequential operations are thereafter performed on the severed envelope blanks to form side seam envelopes. The method includes the steps of periodically cutting the side edges of the continuously moving web to form envelope side flaps. The web is then scored longitudinally along the side flaps and the side flaps are thereafter folded into overlying relation with the body of the web. The web is thereafter transversely scored for the top and bottom flaps of the envelope.

The web is severed at preselected locations to form envelope blanks with the folded side flaps. The severed envelope blanks are then separated from each other by pull out rollers and gum is applied to the upper surface of the side flaps while the envelope blanks are in spaced relation to each other. The bottom flap is thereafter folded into overlying relation with the side flaps and secured thereto to form a pocket in the envelope. The thus formed envelopes are thereafter moved into overlying relation with each other so that only the portion of the top flap to which gum is to be applied is exposed. Gum is applied to that portion of the top flaps and the envelopes are dried in a suitable drying device. The top flap is thereafter folded into overlying relation with the bottom flap and the formed envelopes are delivered to a suitable delivery device.

With the above method, before the envelope blank is severed from the web, side flaps are formed in the envelope blank, longitudinal scores are made in the web for the side flaps and the side flaps are folded into overlying relation with the body of the envelope. The envelope blanks are then scored transversely for the top and bottom flaps. Thereafter the envelope blanks are severed from the web and glue is applied to the side flaps. Thereafter the remaining envelope making operations are sequentially performed on the separate envelope blanks. A stationary anvil may be utilized at the cut off station to sever the envelope blanks from the web. Standard side flap gummers may be employed to apply glue to the side flaps and it is not necessary to change the diameter of the gummer roll with each envelope size change.

Accordingly, the principal object of this invention is to provide a method for making envelopes from a web that permits rapid and inexpensive size change of the envelopes made from the web.

Another object of this invention is to provide a method for making envelopes from a web in which the glue is applied to the envelope side flaps after the envelope blank has been severed from the web.

DESCRIPTION OF THE PREFERRED EMBODIMENT

Throughout the specification, the various operations performed in the forming of an envelope from a web of paper will be described in conjunction with mechanical components capable of performing the specific operations on both the web and the envelope blanks. For reasons of clarity and brevity, the specific components are not described in detail. It should be understood, unless stated otherwise, that conventional components well known in the art may be utilized to perform the various operations on both the web and the envelope blank. The term "side seam" is intended to designate inside side seam envelopes where the bottom flap is folded over the folded side flap as distinguished from outside side seam envelopes where the side flaps are folded over the folded bottom flap.

Figure 1:
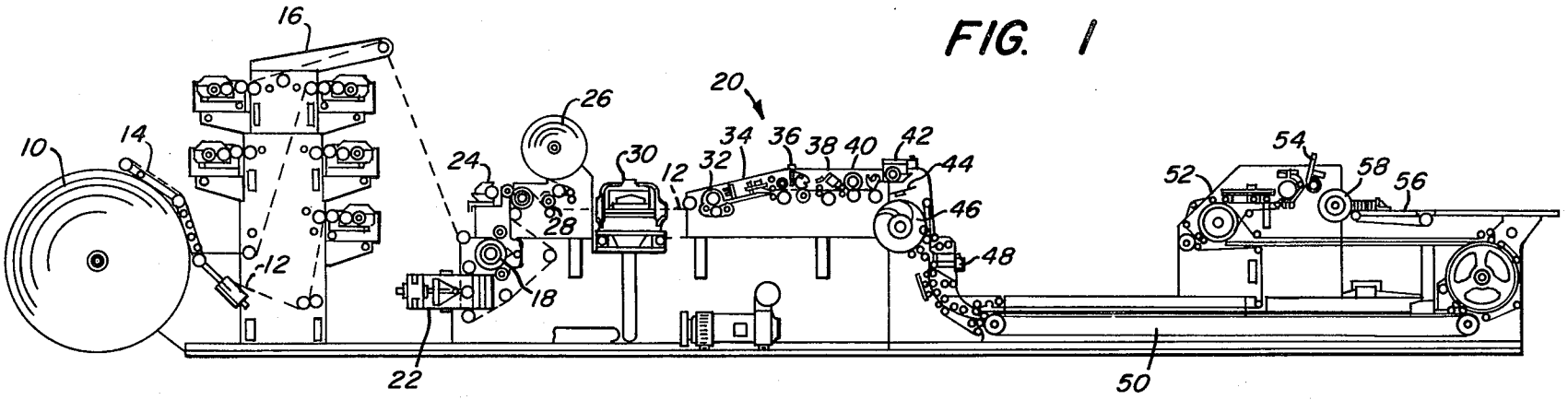
FIG. 1 is a diagrammatic view in side elevation of an envelope making machine suitable for continuously making side seam envelopes in accordance with the hereinafter described method.

Referring to the drawings and particularly FIG. 1 there is diagrammatically illustrated a reel of paper web material 10 from which the envelopes are to be formed. The web 12 is unwound from the reel 10 in a controlled manner and a reel brake 14 is provided to control the unwinding of the web 12 from the reel 10. Suitable printing apparatus 16 is positioned adjacent the reel 10 and the continuous web is reeved about the printing rollers to print on either one or both sides of the web 12. The web 12 is then conveyed at a controlled speed by means of a pull cylinder 18 into the envelope making machine 20.

A panel cutting device 22 is positioned adjacent the pull rolls 18 and is arranged to periodically form rectangular windows in the web in spaced relation to each other. Gum applying apparatus 24 applies gum around the edges of each window cut in the continuous web. Adjacent the gumming device there is a reel 26 of window material from which patches of window material are severed and applied to the continuous web in overlying relation with each of the windows formed in the web at a window patch applying station 28. The continuous web 12 is then conveyed through side flap cutting apparatus 30 similar to the side flap cutting apparatus illustrated and described in U.S. Pat. No. 3,782,233. The flap cutting device 30 cuts portions of the side edges of the web material 12 to form spaced side flaps in the web 12.

The web with the formed side flaps is then conveyed between scorer rollers 32 where longitudinal score lines are formed in the web along the transversely extending side flaps. The web 12 is then conveyed through a side flap folding device 34 where the side flaps are folded along the side flap score lines. Upstream from the side flap folding device 34 transverse scorers 36 form transverse scores in the web for the envelope bottom and top flaps. Severing devices or cutters 38 which include a stationary backing anvil are positioned upstream from the transverse scorer rollers and sever envelope blanks from the continuous web.

Pullout segments 40 accelerate the severed envelope blanks to space the envelope blanks from each other. Gumming apparatus 42 applies gum to the folded side flaps of the severed envelope blanks and the envelope blanks are conveyed into a bottom flap folding device 44 where the bottom flap is folded into overlying relation with the folded side flaps to form the pocket in the envelope blank.

The formed envelopes are then conveyed into a collator device 46 which is similar to the collator illustrated and described in U.S. Pat. No. 3,847,384 and discharged therefrom in lapped relation so that the only portion of the envelope blank that is exposed is the upper peripheral edge of the top flap. Gumming apparatus 48 applies gum to the exposed portions of the envelope blank top flaps. Thereafter the envelope blanks are slightly separated and conveyed through a drier 50 where the gum applied to the top flaps is dried. The envelopes are then conveyed to an aligning device 52 and into a folder 54 where the top flap is folded into overlying relation with the bottom flap. The folded envelopes are conveyed to a delivery table 56 by means of a delivery wheel 58.

Figure 2:
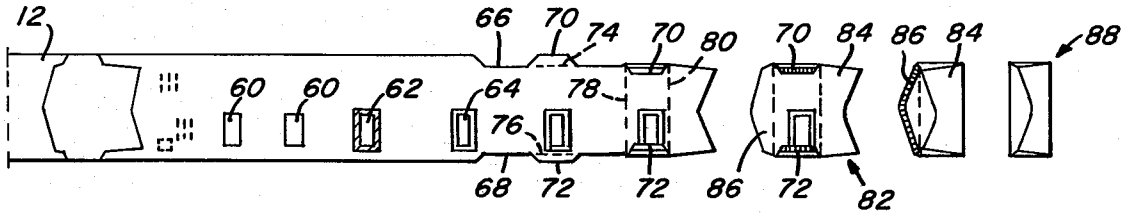
FIG. 2 is a diagrammatic view of the sequential operations performed on the web and several envelope blanks to form envelopes therefrom.

Referring to FIG. 2 wherein the sequential steps of forming the envelope from the web 12 is illustrated diagrammatically, the web 12 after being printed on one or both sides by the printing apparatus 16 is conveyed to the panel cutter apparatus where a plurality of spaced windows 60 are formed in the web by the panel cutter apparatus 22. Thereafter gum 62 is applied to the edges of the window in the web 12 by the gumming apparatus 24. Glassine windows 64 are positioned in overlying relation with the window 60 by the window patch applying device 28. The side flap cutting device 30 forms recessed portions 66 and 68 in the web to form side flaps 70 and 72. Longitudinal score lines 74 and 76 are formed in the web 12 by the scorer 32. Thereafter the side flaps 70 and 72 are folded over the web 12 by the folding device 34 and thereafter transverse scores 78 and 80 are formed in the web to form the score lines for the envelope top flap and bottom flap. The cutting device 38 severs the envelope blank 82 from the web 12 provided preselected configurations for the edges of bottom flap 84 and top flap 86.

After the envelope blank 82 is severed from the web 12 the pullout segments 40 space the envelope blanks from each other in the envelope machine and gum is applied to the folded side flaps 70 and 72 by the gumming device 14. Thereafter the bottom flap 84 is folded into overlying relation with the side flaps to form a pocket in the envelope blank 82. The formed envelopes 88 are collated into overlying relation by the collator device 46 and gum is applied to the top flap 86. The top flap after drying is then folded over the bottom flap 84 to form the folded envelope 88.

With the above described sequential operations, it is now possible to form envelopes from a web at relatively high speeds and to rapidly change the dimensions of the envelopes formed without substantial modifications to the envelope making machine. The sequential operations of first severing the envelope blank from the web and thereafter applying glue to the side flaps of the severed blank provide the above discussed versatility.

According to the provisions of the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. In a method for making inside side seam envelopes from a web that includes,
   - unwinding a web from a reel,
   - introducing said web into an envelope making machine,
   - cutting the side edges of said web to form spaced envelope side flaps therein,
   - forming longitudinal side flap score lines in said spaced envelope side flaps of said web,
   - folding said envelope side flaps on said web,
   - cutting envelope blanks from said web with said side flaps folded and forming an envelope blank bottom flap portion, the improvement comprising:
   - after said envelope blank is cut from said web applying glue to the upper surface of said folded side flaps of each of said envelope blanks, and
   - thereafter folding said envelope blank bottom portion into overlying relation with the folded side flaps with glue applied to said envelope blank side flaps to thereby form an inside side seam envelope.

2. A method for making inside side seam envelopes from a web as set forth in claim 1 which includes,
   - forming transverse closure flap and bottom flap score lines in said web before said envelope blanks are severed therefrom and before glue is applied to the upper surface of said folded side flaps.

3. A method for making inside side seam envelopes from a web as set forth in claim 1 which includes,
   - forming transverse closure flap and bottom flap score lines in said web on opposite sides of said folded side flaps before said envelope blank is severed from said web and before glue is applied to the upper surface of said folded side flaps.

4. A method for making inside side seam envelopes from a web as set forth in claim 1 which includes,
   - forming windows at spaced intervals in said web before cutting the side edges of said web.

* * * * *